US006123409A

United States Patent [19]

Wolf

[11] Patent Number: 6,123,409

[45] Date of Patent: Sep. 26, 2000

[54] INKJET PRINTHEAD WITH CAPILLARY CHANNELS FOR RECEIVING WIPED INK AND RESIDUE

[75] Inventor: Frederick Andrew Wolf, Boise, Id.

[73] Assignee: Hewlett-Packard Company, Palo Alto, Calif.

[21] Appl. No.: 09/487,331

[22] Filed: Jan. 19, 2000

[51] Int. Cl.[7] ..... B41J 2/165

[52] U.S. Cl. ..... 347/33

[58] Field of Search ..... 347/33, 87, 22, 347/44

[56] References Cited

U.S. PATENT DOCUMENTS

| | | | |
|---|---|---|---|
| 5,115,250 | 5/1992 | Harmon et al. . | |
| 5,182,582 | 1/1993 | Okamura . | |
| 5,500,660 | 3/1996 | Childers et al. . | |
| 5,555,461 | 9/1996 | Ackerman . | |
| 5,581,282 | 12/1996 | Okamura . | |
| 5,614,930 | 3/1997 | Osborne et al. . | |
| 5,815,176 | 9/1998 | Rotering . | |
| 5,815,177 | 9/1998 | Sasaki | 347/44 |
| 5,896,145 | 4/1999 | Osborne et al. . | |
| 5,905,513 | 5/1999 | Brandon et al. | 347/33 |

FOREIGN PATENT DOCUMENTS

| | | | |
|---|---|---|---|
| 0 383 019 A2 | 8/1990 | European Pat. Off. | 347/33 |
| 58-92568 | 6/1983 | Japan | B41J 3/04 |

*Primary Examiner*—David F. Yockey

[57] ABSTRACT

A replaceable inkjet printhead cartridge with ink and residue collectors thereon which use capillary channels to retain ink and residue wiped from the printhead orifice plate by a resilient wiper blade at a service station at one end of the path of travel of the printhead carriage. Some of the capillary channels are formed between spaced fins which engage the wiper blade. The fins have edges that terminate in a plane spaced from the front edge of the orifice plate in a direction to prevent the wiper blade from engaging a sharp side edge of the orifice plate. Capillary breaks are provided at desired locations to prevent removed ink and residue from migrating to undesired areas on the printhead such as electrical contact areas or pads. The printhead cartridge conveniently allows removal of dried ink and residue from the printer when replacing the cartridge.

17 Claims, 3 Drawing Sheets

INKJET PRINTHEAD WITH CAPILLARY CHANNELS FOR RECEIVING WIPED INK AND RESIDUE

CROSS REFERENCE TO RELATED APPLICATIONS, IF ANY

None.

BACKGROUND OF THE INVENTION AND PRIOR ART

The present invention relates generally to inkjet printers and, more particularly, to the cleaning of printhead wipers which are used to clean the orifices of an orifice plate of a replaceable inkjet printhead cartridge.

The orifice plate of the printhead of an inkjet printer, particularly thermal inkjet printers, tends to pick up contaminants such as paper dust and the like during the printing process. Such contaminants adhere to the orifice plate either because of the presence of ink on the printhead, or because of electrostatic charges. Various methods and apparatus for cleaning the printhead are known in the art. In general, an elastomeric wiper of one form or another is usually provided in a printhead service station at one end of the path of printhead carriage travel so that the printhead carriage and removable inkjet printhead cartridges mounted thereon can be brought into proximity with the wiper or wipers for servicing of the printhead or printheads. Some systems use rotary wipers at the service station for swiping the printhead in a direction orthogonal to the direction of carriage movement. Other systems employ statically mounted wipers which are engaged by the printhead orifice plates during the linear movement of the printhead carriage. One system for periodically cleaning the printhead wipers is shown in U.S. Pat. No. 5,815,176 issued Sep. 29, 1998 to Rotering and owned by the assignee of the present invention. Other systems for cleaning the inkjet wipers are disclosed in U.S. Pat. No. 5,182,582 issued Jan. 26, 1993 to Okamura and U.S. Pat. No. 5,581,282 issued Dec. 3, 1996 to Okamura, each of which employ a perforated plate on the printhead carriage mounted in proximity to the removable printheads in a path to be contacted by a resilient wiper so that the resilient wiper blade can be cleaned during passage over the perforated orifice plate after the wiper has swept and cleaned the printhead orifice plates. Residue is accumulated in an absorber beneath the orifice plate on the carriage.

It is well known that continuing accumulation of ink or other contaminants impairs the quality of the print output by interfering with proper application of the ink to the printing medium. Removal of accumulated ink and other contaminants from the printer or carriage is often a messy and undesirable job which is not regularly performed by users of the printer. It is accordingly an objective of the present invention to provide a replaceable printhead cartridge having a self contained residue collector on the replaceable cartridge which engages and cleans the printhead wipers so that residue accumulated on the cartridge can be removed when removing the cartridge for refilling or disposal.

SUMMARY OF THE INVENTION

The present invention accordingly provides an inkjet printhead comprising a housing, electrical conductors including contact pads on a front side of said housing and an inkjet orifice plate on said front side of said housing in an area to be swept by a resilient printhead wiper on a printer as said printhead is moved relative to said wiper, said housing further including at least one residue collector alongside said orifice plate in said area, said collector comprising a plurality of spaced fins defining first capillary channels between said fins for drawing wiped ink and residue away from said orifice plate by capillary action.

DESCRIPTION OF THE PREFERRED EMBODIMENT

Figure 1:
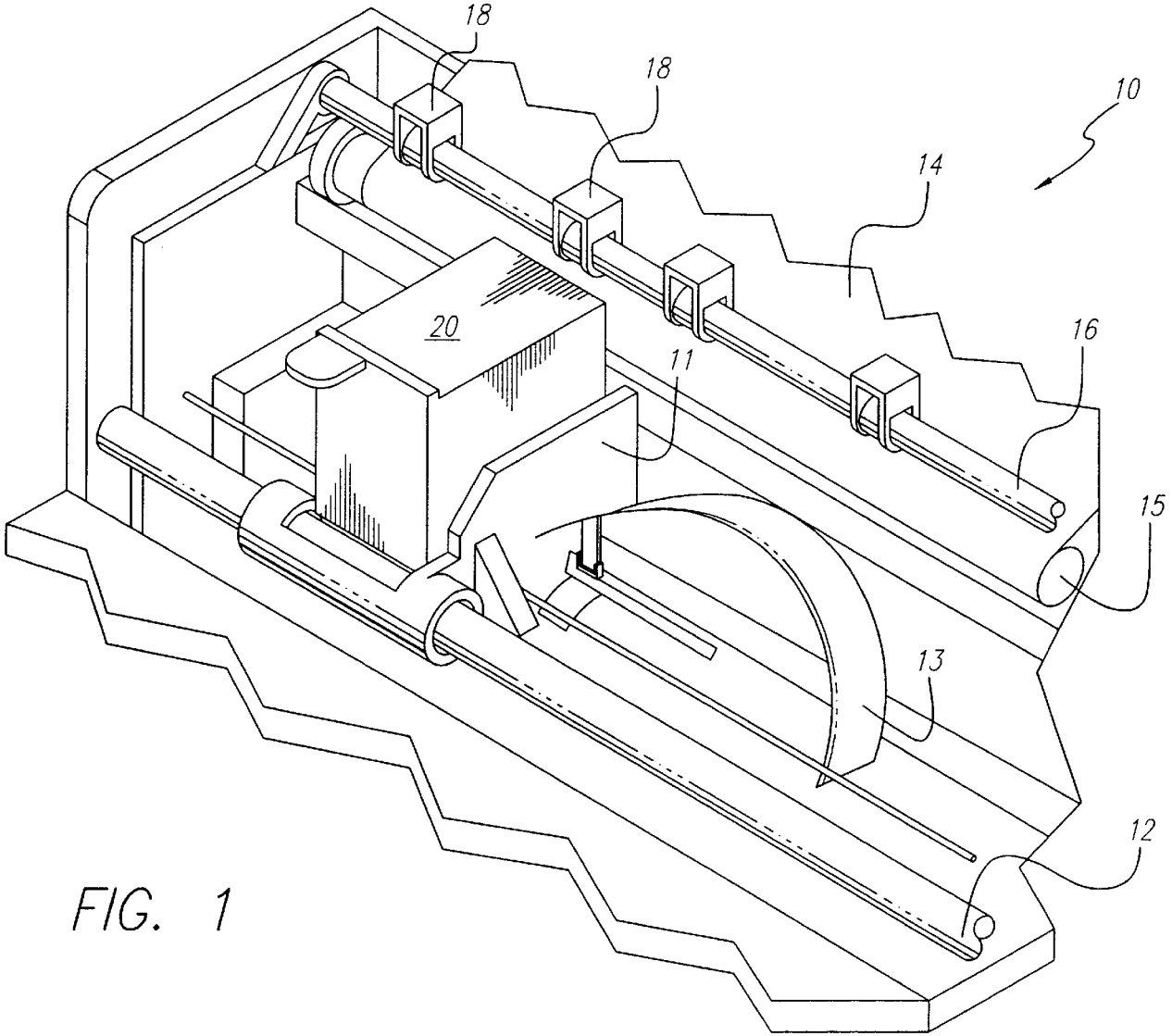
FIG. 1 is a partial perspective view of an inkjet printer in which the printhead of the present invention may be used.

As seen in FIG. 1, an inkjet printer 10 typically includes a printhead carriage 11 mounted on support rods 12 which extend transversely of the printer so that the carriage 11 and a removable printhead or printheads mounted thereon may sweep back and forth laterally of the printer to eject ink droplets horizontally onto the surface of a media sheet 14 trained around a cylindrical platen 15. Another transversely extending shaft 16 supports a plurality of spaced media hold down roller assemblies 18. Electrical power is provided to the carriage 11 and printhead or printheads 20 on the carriage 11 by a flexible conductor strip 13.

Figures 2, 3, 4A, 4B:
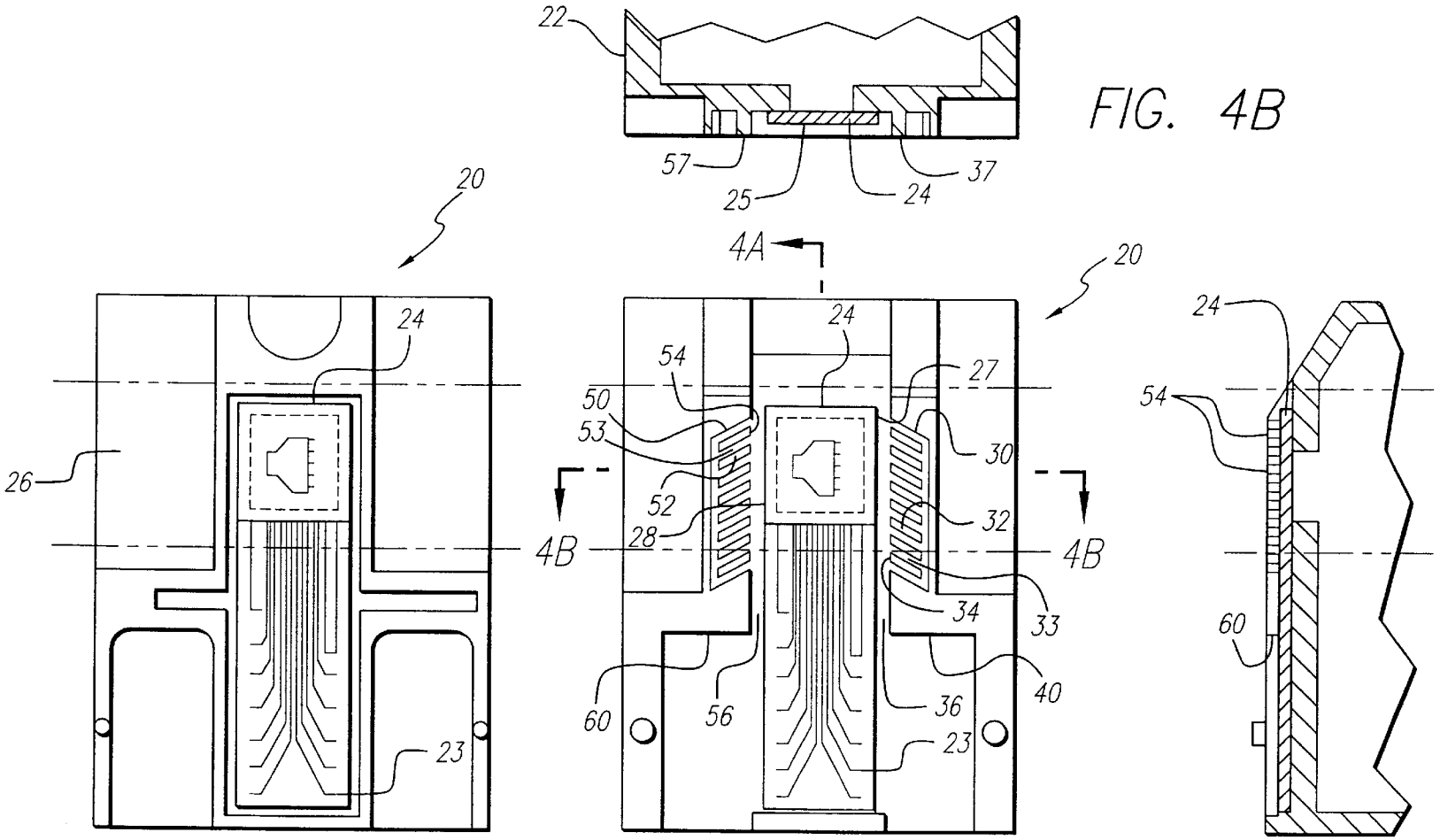
FIG. 2 PRIOR ART
FIG. 2 is a front elevation view of a prior art printhead.
FIG. 3 is a front elevation view of a printhead with capillary ink and residue collectors thereon according to the invention.
FIG. 4A is a vertical cross-section of the printhead taken at lines 4A—4A of FIG. 3.
FIG. 4B is a horizontal cross-section of the printhead taken at lines 4B—4B of FIG. 3.
Figure 5:
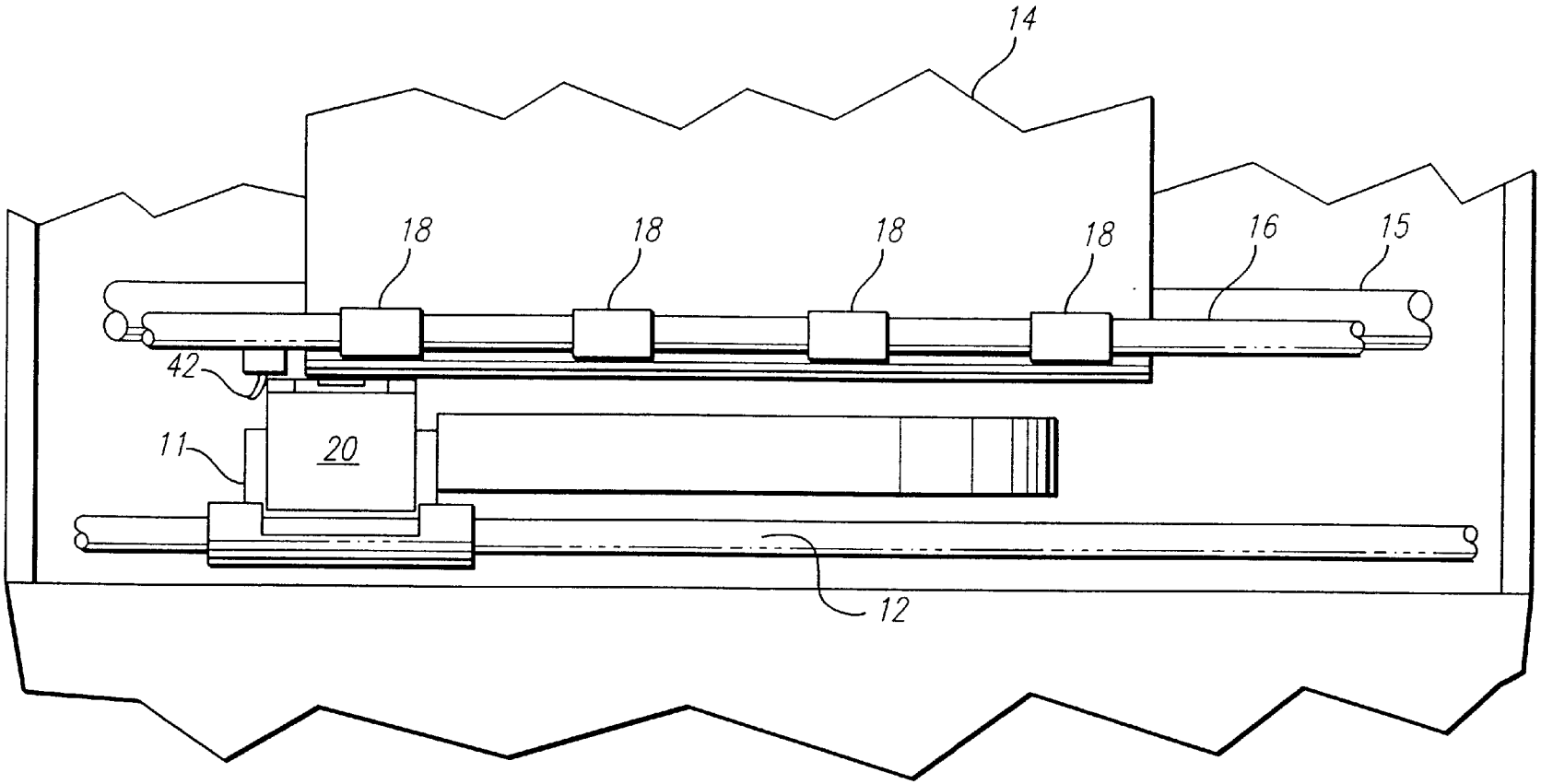
FIG. 5 is a top plan view of the printhead of FIG. 3 in a printer showing wiping of the printhead.

The inkjet printhead 20 is comprised of a generally rectangular hollow housing 22 constructed of light weight plastic and holds an exhaustible supply of ink. When the ink is exhausted, the printhead is manually removed from the printer for disposal or for recycling whereby the printhead may be cleaned and refilled for further use. A typical prior art printhead is shown in FIG. 2 and includes an inkjet orifice plate 24 which may comprise a thermal or piezoelectric printhead having a plurality of microscopic nozzles extending through the orifice plate 24 and through which ink is conducted from the interior of the cartridge housing 22. A plurality of electrical leads through which electrical charge is conducted to fire the individual inozzles extend downwardly from the orifice plate and each terminating in exteriorly exposed contact pads 23 on the front generally planar front surface 25 of the orifice plate 24 from which ink droplets are ejected. A generally horizontally extending strip or barrier defined between the phantom lines shown on FIGS. 2 and 3 comprises an area 26 which is swept by a flexible wiper 42 mounted at a suitable location on the printer (FIG. 5) as the printhead moves into and out of a service station shown at the left side of the printer. Ink and residue swept from the printhead shown in FIG. 2 is received in recesses on the front of the cartridge alongside the orifice plate from which the ink and residue gravitates downwardly.

Turning now to FIG. 3 and 4, the present invention also includes a housing 22, electrical conductors terminating in contact pads 23 and an orifice plate 24 as in the prior art printhead of FIG. 2. Pursuant to the invention, at least one residue collector 30 is provided alongside the orifice plate 24 in the area 26 to be swept by the printhead wiper 42. The residue collector is comprised of a plurality of spaced fins 32 which define capillary channels 33 between the fins for drawing ink and residue removed by the wiper away from the orifice plate 24 by capillary action. In the arrangement shown in FIG. 3, the fins 32 are straight parallel fins which extend angularly downwardly away from the orifice plate 24, the fins being equally spaced to define capillary channels of equal width which may be about 0.02". As shown, the fins are also of the same length and height so that the capillary channels 33 are of equal volume but persons skilled in the art will understand that the capillary width and volumes of the channels may be varied if desired for special purposes. Also, the fins need not necessarily be straight or even parallel provided that the width of the capillary channels between the fins is sufficient to draw ink removed by the as wiper 42 away from the orifice plate 24.

The edge 27 of the orifice plate is laterally spaced from ends 34 of the fins 32 a distance which defines a second capillary channel 36 which extends vertically between the edge 27 of the orifice plate 24 and the ends 34 of the fins. The capillary channel 36 is slightly wider, e.g., about 0.03" than the first capillary channels 33 so that the capillary action of the first channels 33 tends to pull ink and residue out of and away from the second capillary channel 36. At the lower end of the second capillary channel 36 is a widened area providing a capillary break 40 above the electrical contact pads 24. The capillary break 40 ensures that ink and residue do not drain downwardly through the channel 36 past the break 40 to thus come into contact with the electrical contact pads 23 which should remain clean.

The printhead housing 22 is constructed such that the orifice plate 24 is mounted in a vertically extending recess bounded by forwardly extending ends 37 of the fins 32 such that the substantially flat front surface 25 of the orifice plate 28 is recessed away from the fin ends 37. This prevents the wiper 42 from contacting the side edges 27, 28 of the orifice plate which may be relatively sharp and thus cause undue wear of the resilient wiper 42.

A second residue collector 50 is also preferably provided on the front of the printhead as seen in FIG. 3 and, as shown, is constructed identically with the residue collector 30. The fins 52 of a second residue collector 50 are also angled downwardly and away from the adjacent edge 28 of the orifice plate 24 and provide capillary channels 53 between the fins 52 for attracting and retaining ink and residue swept by the wiper blade 42 from the orifice plate 24. A vertically extending channel 56 of width greater than the width of the capillary channels 53 is also provided and the front edges 57 of the fins 52 occupy the same plane as the front edges 37 of the fins 32 of the first residue collector 30 so that neither side edge 27 or 28 of the orifice plate 24 will come into contact with the wiper blade 42.

In operation of the printer, movement of the printhead carriage 11 into a printhead service station at one or both sides of the printer results in the wiper blade 42 first contacting one or the other of the residue collectors 30, 50 as the wiper 42 sweeps the area 26 so that the fins in the residue collector first angularly contact the wiper 42 and remove any ink and residue on the wiper 42 before the wiper contacts the orifice plate 24. After the now cleaned wiper 42 wipes and cleans the orifice plate 24, then the wiper 42 is cleaned by contacting the angularly arranged fins in the other residue collector to remove residue and ink removed from the orifice plate by the wiper 42. The capillary channels 33, 53 between the fins of each residue collector and the capillary channels 36, 56 between the residue collectors and the orifice plate cooperate with each other to ensure that ink and residue is directed to appropriate storage areas and to ensure that ink and residue is not directed towards undesired areas such as the electrical contact pads 23. The capillary breaks 40, 60, as shown in the form of 90° outside corners, effectively eliminate the capillary forces at the desired locations by providing a very large contact wetting angle which assures retention of the liquid ink and any residue or contaminants therein in the capillary channels. It should also be noted that accumulating fibrous paper residue and dust which is retained in the capillary channels 33, 53 significantly increases the capillary force in the capillary channels as compared with the capillary force in the relatively clean channels 33, 53 at the outset.

Persons skilled in the art will appreciate that various additional modifications can be made in the preferred embodiment shown and described above and that the scope of protection is limited only by the wording of the claims which follow.

What is claimed is:

1. An inkjet printhead comprising a housing electric conductors including contact pads on a front side of said housing and an inkjet orifice plate on said front side of said housing in an area to be swept by a resilient printhead wiper on a printer as said ptrinthead is moved relative to said wiper, said housing further including at least, one residue collector alongside said orifice plate in said area, said collector comprising a plurality of spaced fins defining first capillary channels between sad fins for drawing wiped ink and residue away from said orifice plate by capillary action, said fins having ends laterally spaced from a first edge of said orifice plate a distance which defines a second capillary channel between said ends of said fins and said first edge of said orifice plate and a capillary break terminating said second capillary channel between said orifice plate and said electrical contact pads, said orifice plate having a substantially flat front surface and said fins having edges which terminate in a plane spaced from the front surface of said orifice plate in a direction to prevent a printhead from engaging a sharp side edge of said orifice plate.

2. The inkjet printhead of claim 1, wherein at least some of said first capillary channels are of equal width.

3. The inkjet printhead of claim 2, wherein at least some of said first capillary channels are of equal volume.

4. The inkjet printhead of claim 2, wherein said first capillary channels are parallel to each other.

5. The inkjet printhead of claim 4, wherein said fins are straight.

6. The inkjet printhead of claim 1, further comprising a second said residue collector alongside said orifice plate in said area to be swept by a resilient printhead wiper, said second residue collector being located on the side of said orifice plate opposite said first residue collector, said second residue collector comprising a plurality of spaced fins defining third capillary channels between said fins of said second residue collector for drawing wiped ink and residue away from said orifice plate by capillary action.

7. The inkjet printhead of claim 6, wherein the ends of the fins of said second residue collector are laterally spaced from a second edge of said orifice plate to define a fourth capillary channel between said ends of said fins of said second residure collector and said second edge of said orifice plate.

8. The inkjet printhead of claim 7, wherein said capillary channels between said fins of said second residue collector extend downwardly away from said fourth capillary channel.

9. The inkjet printhead of claim 8, wherein each of sad third capillary channels between said fins of said second residue collector have a width less than a width of said fourth capillary channel.

10. The inkjet printhead of claim 9, further comprising a capillary break terminating said fourth capillary channel between said orifice plate and said electrical contact pads.

11. The inkjet printhead of claim 10, wherein said orifice plate has a substantially flat front surface and said fins of said second residue collector have edges which terminate in a plane spaced from said substantially flat front surface of said orifice plate in a direction to prevent a printhead wiper from engaging a sharp side edge of said orifice plate.

12. The inkjet printhead of claim 11, wherein at least some of said third capillary channels between said fins of said second residue collector are of equal width.

13. The inkjet printhead of claim 12, wherein at least some of said third capillary channels between said fins of said second residue collector are of equal volume.

14. The inkjet printhead of claim 11, wherein said third capillary channels between said fins of said second residue collector are parallel to each other.

15. The inkjet printhead of claim 14, wherein said fins of said second residue collector are straight.

16. The inkjet printhead of claim 1, wherein said first capillary channels extend downwardly away from said second capillary channel when said printhead is mounted in a printer.

17. The inkjet printhead of claim 1, wherein each of said first capillary channels have a width less than a width of said second capillary channel.

* * * * *